US007928055B2

(12) United States Patent
Gizaw et al.

(10) Patent No.: US 7,928,055 B2
(45) Date of Patent: Apr. 19, 2011

(54) CLEAR AND/OR TRANSLUCENT FABRIC ENHANCERS COMPRISING NANO-SIZED PARTICLES

(75) Inventors: Yonas Gizaw, Cincinnati, OH (US); Francesc Corominas, Brussels (BE); Alessandro Corona, III, Mason, OH (US); Marc Johan Declercq, Strombeek (BE); Hugo Jean Marie Demeyere, Merchtem (BE); Ivan Maurice Alfons Jan Herbots, Wetteren (BE); Andreas Leopold, Merchtem (BE); Matthew Lawrence Lynch, Mariemont, OH (US); Raul Victorino Nunes, Loveland, OH (US); Ke-ming Quan, West Chester, OH (US); Alice Marie Ward, Middletown, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 502 days.

(21) Appl. No.: 11/890,924

(22) Filed: Aug. 8, 2007

(65) Prior Publication Data

US 2009/0042767 A1 Feb. 12, 2009

(51) Int. Cl.
*C11D 17/00* (2006.01)

(52) U.S. Cl. ..... 510/527; 510/522

(58) Field of Classification Search ..... 510/522, 510/527

See application file for complete search history.

(56) References Cited

U.S. PATENT DOCUMENTS

| | | | | |
|---|---|---|---|---|
| 3,954,634 | A | 5/1976 | Monson et al. | |
| 5,525,245 | A * | 6/1996 | Grandmaire et al. | 510/524 |
| 5,759,990 | A | 6/1998 | Wahl et al. | |
| 6,875,735 | B1 | 4/2005 | Frankenbach et al. | |
| 7,037,887 | B2 | 5/2006 | Frankenbach et al. | |
| 2002/0119188 | A1 | 8/2002 | Niemiec et al. | |
| 2003/0143181 | A1 | 7/2003 | Hensen et al. | |

FOREIGN PATENT DOCUMENTS

| | | | |
|---|---|---|---|
| EP | 0309052 | A | 3/1989 |
| EP | 1396260 | A | 3/2004 |
| WO | WO2007/006367 | A | 1/2007 |
| WO | WO 2008/040785 | A1 | 4/2008 |

* cited by examiner

*Primary Examiner* — John R Hardee
(74) *Attorney, Agent, or Firm* — Melissa G. Krasovec; Gary J. Foose; Steven W. Miller

(57) ABSTRACT

A fabric enhancer comprising: at least one fabric softening active, wherein said at least one fabric softening active comprises a plurality of particles comprising an intensity weighted particle size distribution wherein greater than about 95% of said plurality of particles have a size below about 170 nm.

11 Claims, 2 Drawing Sheets

CLEAR AND/OR TRANSLUCENT FABRIC ENHANCERS COMPRISING NANO-SIZED PARTICLES

BACKGROUND

The need for clear and/or translucent fabric enhancers has been reported. See e.g. U.S. Pat. No. 6,875,735 to Frankenbach et al.; U.S. Pat. No. 5,759,990 to Wahl et al.; WO 97/03169 to Trihn et al. Conventional formulation techniques used to address fabric enhancer clarity issues have focused on controlling the chemical make-up of the formulations by adding turbidity modifying additives and by manipulating the type of fabric softening active used. See e.g. U.S. Pat. No. 7,037,887 to Frankenbach et al. Attempts to control the turbidity of fabric enhancers involve the addition of turbidity or clarity modifying actives, such as solvent systems having specific characteristics such as ClogP values, and the addition of electrolyte to broaden the range of solvent systems which can be used. Attempts to manipulating the type of fabric softening active used include the use of fabric softening actives having low phase transition temperature. Although these technologies have been able to provide clarity benefits to fabric enhancer compositions, these approaches can be cost prohibitive on a commercial scale resulting. As such, there remains a need for clear and/or translucent fabric enhancers which can be produced without reliance on the addition of turbidity modifying additives and can be applicable to a broader range of fabric softening actives.

SUMMARY OF THE INVENTION

One aspect of the present invention provides for a fabric enhancer comprising: at least one fabric softening active, wherein said at least one fabric softening active comprises a plurality of particles comprising an intensity weighted particle size distribution of greater than about 95% of said plurality of particles have a particle size below about 170 nm.

Another aspect of the invention provides a process to produce a fabric enhancer comprising: forming a first feed comprising from about 5% to about 100% of a fabric softening active; from about zero to about 70% of a solvent, and with from about zero % to about 30% of a perfume, by weight of said first feed; premixing said first feed to form a premixed first feed; combining said premixed first feed with a second feed comprising up to about 100% of water in a mixing chamber; subjecting said feed to an energy density from about 1 J/ml to about 50 J/ml thereby producing said fabric enhancer; and discharging said fabric enhancer at a flow rate from about 1 kg/min to about 1000 kg/min.

DETAILED DESCRIPTION

I. Fabric Enhancers

Figure 1:
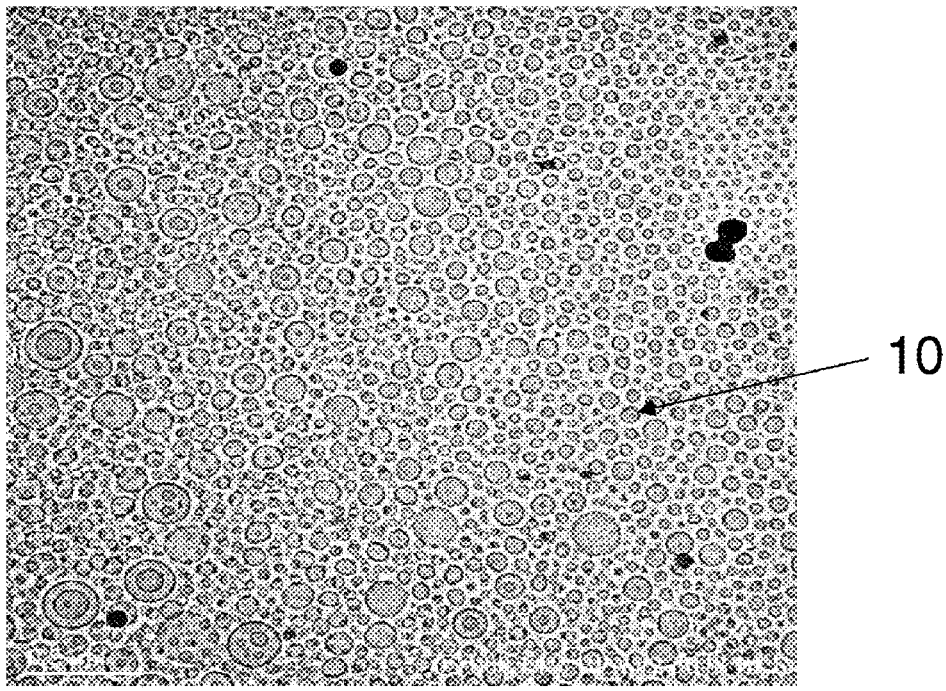
FIG. 1 provides a Cryo-TEM micrograph of nano-sized particles comprising a plurality of nano-sized lamellar vesicles according to the present invention.

It has surprisingly been found that fabric enhancers comprising at least one fabric softening active, wherein said at least one fabric softening active comprises a plurality of particles, comprising an intensity weighted particle size distribution wherein at least about 95% of said plurality of particles have a particle size below about 170 nm, hereinafter referred to as "nano-particles" provide a clear and/or translucent fabric enhancer, i.e. having a clarity value of less than about 320 NTU. It has been found that these nano-particles are able to achieve clear and/or translucent fabric enhancers without relying on conventional formulation approaches described herein. Without intending to be bound by theory, it is believed that these nano-sized particles are sufficiently small to allow sufficient transmission of light such that the compositions appear clear and/or translucent, in accordance with the Turbimeter Turbidity Method, defined herein.

A. Nano-Sized Particles

The present invention comprises at least one fabric softening active comprising a plurality of particles comprising an intensity weighted particle size distribution, wherein from about 95%, alternatively from about 98% to about 99%, alternatively to about 99.9%, alternatively to about 100% of said plurality of particles have a size below about 170 nm, alternatively from about 10 nm to about 170 nm, forming a plurality of nano-sized particles. It has been found that this plurality of nano-sized particles provides a clarity value of below about 320 NTU in the absence of added solvent and/or electrolyte. In another embodiment, where the intensity weighted particle size distribution is from about 70%, alternatively from about 90, alternatively from about 95% to about 99%, alternatively to about 99.9%, alternatively to about 100% of the particles have a size below about 100 nm provides a clarity value of below about 200 NTU, alternatively below about 150 NTU, alternatively below about 100 NTU, in the absence of added solvent and/or electrolyte. The intensity weighted particle size distribution is determined in accordance with the Dynamic Light Scattering Method, defined herein.

In addition to the particle size distribution described above, the plurality of particles can further comprise an average particle size of from about 30 nm to about 120 nm. It has been found that fabric enhancers comprising the particle size distribution and an average particle size as defined herein provide a clarity value of below about 320 NTU in the absence of solvents and/or electrolytes. In one embodiment, a fabric enhancer further comprising an average particle size range of from about 100 nm to about 120 nm provides a clarity value of from about 200 NTU to about 320 NTU, in the absence of added solvent and/or electrolyte. In another embodiment, a fabric enhancer further comprising an average particle size range of from about 30 nm to about 100 nm provides a clarity value of from about 50 NTU to about 200 NTU, in the absence of added solvent and/or electrolyte.

Said plurality of particles typically comprise lamellar vesicles, discs, platelets, lamellar sheets, and combinations thereof. As used herein, particle size and average particle size are determined by the Dynamic Light Scattering Method as defined herein.

Figure 2:
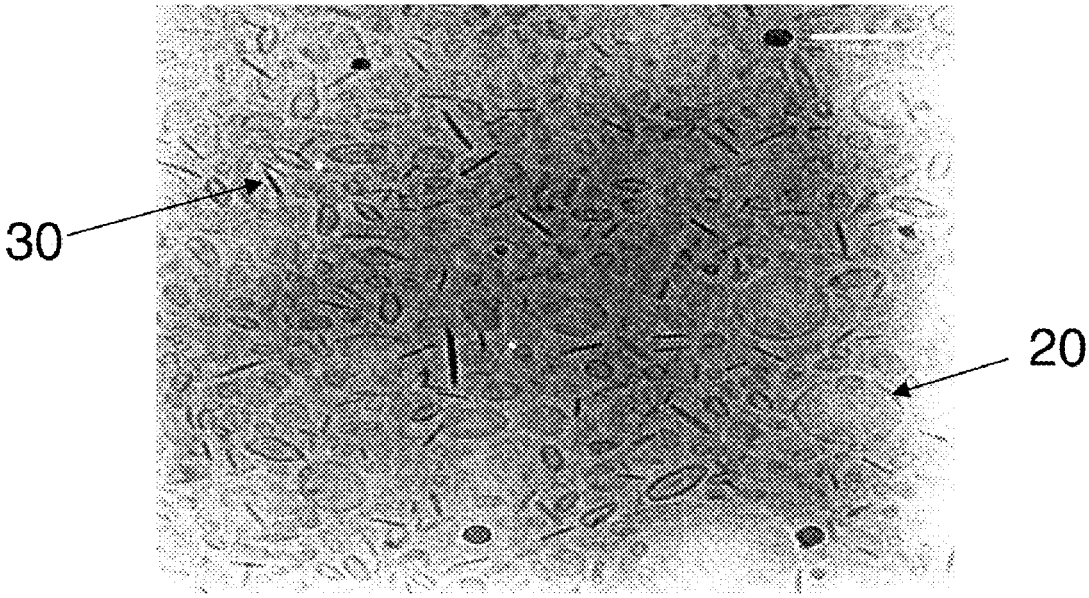
FIG. 2 provides a Cryo-TEM micrograph of nano-sized particles comprising a plurality of nano-sized lamellar vesicles, of disc and lens shaped vesicles according to the present invention.
Figure 3:
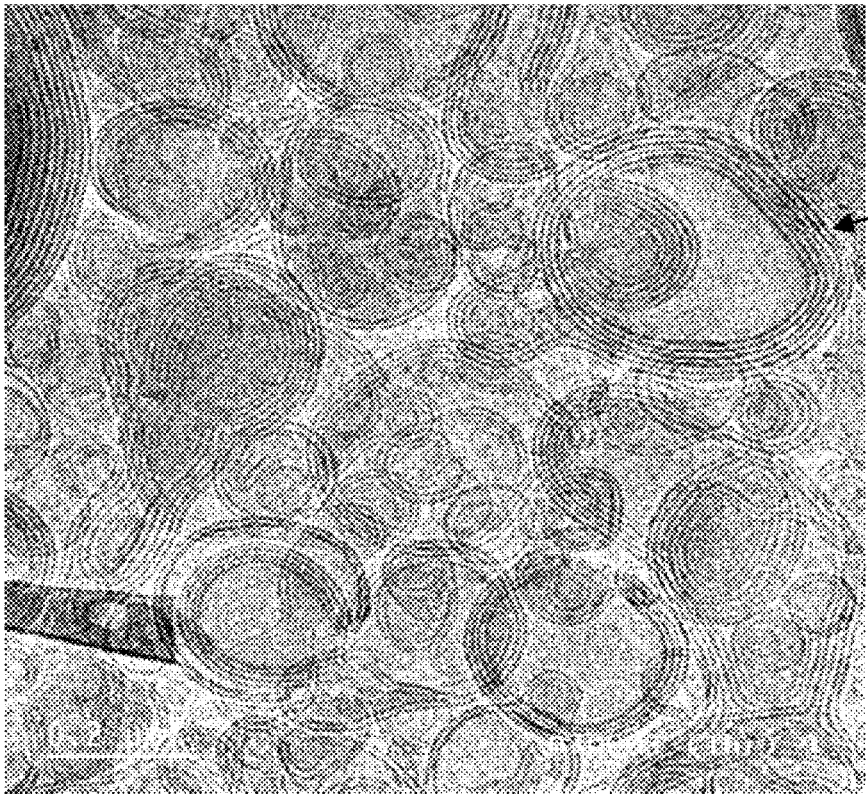
FIG. 3 provides a Cryo-TEM micrograph of a conventional fabric enhancer composition showing multi-lamellar vesicles having non-nano-sized diameters.

FIG. 1 provides a Cryo-TEM micrograph of a plurality of nano-sized particles (10) according to the present invention. FIG. 2 provides a Cryo-TEM micrograph of a plurality of nano-sized lamellar vesicles (20), of disc and lens shaped vesicles (30) according to the present invention. FIGS. 1 and 2 are within the scope of the invention. FIG. 3 provides a Cryo-TEM micrograph of a conventional fabric enhancing composition showing a plurality of lamellar vesicles (40) having non-nano-sized diameters, e.g. with diameters greater than about 200 nm and being multi-lamellar.

Dynamic Light Scattering Method

The Dynamic Light Scattering Method can be used to measure the particle size by light scattering data techniques, which is an intensity-weighted average diameter. As used herein, the particle size is determined with a Malvern Zetasizer Nano ZS—model ZEN 3600. Manufacturer:

Malvern Instruments Ltd, Enigma Business Park, Grovewood Road, Malvern, Worcestershire WR14 1XZ, United Kingdom.

The software used for control of the instrument and for data acquisition is the Dispersion Technology Software version 4.20 ©) Malvern Instruments Ltd.

The results are expressed as an intensity distribution versus particle size. From this distribution, the % based particles size distribution and the average particle size can be determined. All samples are measured within 24 h after making.

The sample is diluted with a dispersant that has similar composition as the continuous phase of the sample e.g water, solvent and acid in same amounts as in the dispersion continuous phase, to get a concentration of the fabric softening active of between about 1% and about 3% in the dispersion being measured. The samples should be taken at a consistent sample volume, e.g 5 ml. The sample is placed in a disposal cuvette (DTS0012 from Malvern) the measurement is taken at 25° C. with sample equilibration time of 2 minutes.

The measurement setting in the above defined software is 'manual measurement' with 20 runs/measurement and run duration of 10 sec's. The number of measurements is 2, without delay between measurements. The result calculation by the above software uses the general purpose model as provided by the software. The results need to meet the internally set quality criteria by soft and hardware.

B. Fabric Softening Active

The fabric enhancers of the present invention comprises a fabric softening active (FSA) or a mixture of more than one FSAs. In one embodiment, the fabric enhancer comprises at least about 1%, alternatively at least about 2%, alternatively at least about 3%, alternatively at least about 5%, alternatively at least about 10%, and alternatively at least about 12%, and less than about 90%, alternatively less than about 40%, alternatively less than about 30%, alternatively less than about 20%, alternatively less than about 18%, alternatively less than about 15%, of said FSA, by weight of the composition. In one embodiment, the FSA is cationic.

One suitable FSA comprises compounds of the formula $$\{R_{4-m}—N^+—[(CH_2)_n—Y—R^1]_m\}X^- \quad (1)$$

wherein each R substituent is either hydrogen, a short chain $C_1$-$C_6$, suitably $C_1$-$C_3$ alkyl or hydroxyalkyl group, e.g., methyl, ethyl, propyl, hydroxyethyl, and the like, poly($C_{2-3}$ alkoxy), suitably polyethoxy, benzyl, or mixtures thereof, each m is 2 or 3; each n is from 1 to about 4, suitably 2; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$-$C_{22}$, suitably $C_{14}$-$C_{20}$, with each $R^1$ being a hydrocarbyl, or substituted hydrocarbyl group, and $X^-$ can be any softener-compatible anion, such as chloride, bromide, methylsulfate, ethylsulfate, sulfate, and nitrate.

A second suitable FSA has the general formula:

$$[R_3N^+CH_2CH(YR^1)(CH_2YR^1)]X^-$$

wherein each Y, R, $R^1$, and $X^-$ have the same meanings as before. Such compounds include those having the formula:

$$[CH_3]_3N^{(+)}[CH_2CH(CH_2O(O)CR^1)O(O)CR^1]Cl^{(-)} \quad (2)$$

wherein each R is a methyl or ethyl group and suitably each $R^1$ is in the range of $C_{15}$ to $C_{19}$. When the diester is specified, it can include the monoester that is present.

These types of agents and general methods of making them are disclosed in U.S. Pat. No. 4,137,180, Naik et al., issued Jan. 30, 1979. An example of a suitable DEQA (2) is the "propyl" ester quaternary ammonium fabric softener active having the formula 1,2-di(acyloxy)-3-trimethylammoniopropane chloride.

A third suitable FSA has the formula:

$$[R_{4-m}—N^+—R^1{}_m]X^- \quad (3)$$

A fourth suitable FSA has the formula:

(4)

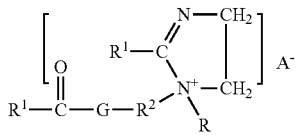

wherein each R, $R^1$, and $A^-$ have the definitions given above; each $R^2$ is a $C_{1-6}$ alkylene group, suitably an ethylene group; and G is an oxygen atom or an —NR— group.

A fifth suitable FSA has the formula:

(5)

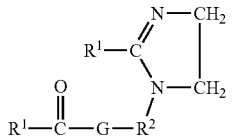

wherein $R^1$, $R^2$ and G are defined as above.

A sixth suitable FSA comprises condensation reaction products of fatty acids with dialkylenetriamines in, e.g., a molecular ratio of about 2:1, said reaction products containing compounds of the formula:

$$R^1—C(O)—NH—R^2—NH—R^3—NH—C(O)R^1 \quad (6)$$

wherein $R^1$, $R^2$ are defined as above, and each $R^3$ is a $C_{1-6}$ alkylene group, suitably an ethylene group and wherein the reaction products may optionally be quaternized by the additional of an alkylating agent such as dimethyl sulfate. Such quaternized reaction products are described in additional detail in U.S. Pat. No. 5,296,622, issued Mar. 22, 1994 to Uphues et al.

A seventh suitable FSA has the formula:

$$[R^1—C(O)—NR—R^2—N(R)_2—R^3—NR—C(O)—R^1]^+A^- \quad (7)$$

wherein R, $R^1$, $R^2$, $R^3$ and $A^-$ are defined as above.

An eighth suitable FSA comprises reaction products of fatty acid with hydroxyalkylalkylenediamines in a molecular ratio of about 2:1, said reaction products containing compounds of the formula:

$$R^1—C(O)—NH—R^2—N(R^3OH)—C(O)—R^1 \quad (8)$$

wherein $R^1$, $R^2$ and $R^3$ are defined as above.

A ninth suitable type of FSA has the formula:

(9)

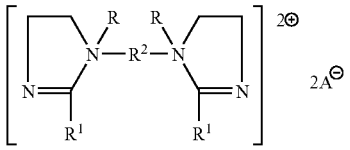

wherein R, $R^1$, $R^2$, and $A^-$ are defined as above.

Non-limiting examples of compound (1) are N,N-bis (stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl) N-(2 hydroxyethyl) N-methyl ammonium methylsulfate.

Non-limiting examples of compound (2) is 1,2di(stearoyl-oxy) 3 trimethyl ammoniumpropane chloride.

Non-limiting examples of compound (3) are dialkylene-dimethylammonium salts such as dicanoladimethylammonium chloride, di(hard)tallowedimethylammonium chloride dicanoladimethylammonium methylsulfate. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

A non-limiting example of compound (4) is 1-methyl-1-stearoylamidoethyl-2-stearoylimidazolinium methylsulfate wherein $R^1$ is an acyclic aliphatic $C_{15}$-$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft®.

A non-limiting example of compound (5) is 1-tallowylamidoethyl-2-tallowylimidazoline wherein $R^1$ is an acyclic aliphatic $C_{15}$-$C_{17}$ hydrocarbon group, $R^2$ is an ethylene group, and G is a NH group.

A non-limiting example of compound (6) is the reaction products of fatty acids with diethylenetriamine in a molecular ratio of about 2:1, said reaction product mixture containing N,N"-dialkyldiethylenetriamine with the formula:

$$R^1—C(O)—NH—CH_2CH_2—NH—CH_2CH_2—NH—C(O)—R^1$$

wherein $R^1$—C(O) is an alkyl group of a commercially available fatty acid derived from a vegetable or animal source, such as Emersol® 223LL or Emersol® 7021, available from Henkel Corporation, and $R^2$ and $R^3$ are divalent ethylene groups.

A non-limiting example of compound (7) is a difatty amidoamine based softener having the formula:

$$[R^1—C(O)—NH—CH_2CH_2—N(CH_3)(CH_2CH_2OH)—CH_2CH_2—NH—C(O)—R^1]^+ CH_3SO_4^-$$

wherein $R^1$—C(O) is an alkyl group, available commercially from the Witco Corporation e.g. under the trade name Varisoft® 222LT.

A non-limiting example of compound (8) is the reaction products of fatty acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is an alkyl group of a commercially available fatty acid derived from a vegetable or animal source, such as Emersol® 223LL or Emersol® 7021, available from Henkel Corporation.

A non-limiting example of compound (9) is the diquaternary compound having the formula:

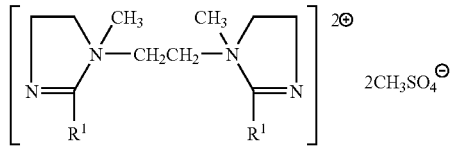

wherein $R^1$ is derived from fatty acid, and the compound is available from Witco Company.

It will be understood that combinations and mixtures of any of the above types of FSAs disclosed above are suitable for use in this invention.

1. Anion A

In the cationic nitrogenous salts herein, the anion $A^-$, which is any softener compatible anion, provides electrical neutrality. Most often, the anion used to provide electrical neutrality in these salts is from a strong acid, especially a halide, such as chloride, bromide, or iodide. Other anions can also be used, such as chloride, methylsulfate, ethylsulfate, sulfate, carbonate, and the like. The anion can also carry a double charge in which case $A^-$ represents half a group.

2. Iodine Value

It has been surprisingly found that fabric enhancer compositions comprising a plurality of nano-sized particles provide clear fabric enhancer compositions without requiring Iodine Values (herein referred to as "IV") of from about 70 to about 140. As such, it has been found that fabric enhancers comprising nano-sized particles as disclosed above are capable of providing clear and/or translucent compositions with a broader range of IV values. As defined here, Iodine Value is the number of grams of iodine absorbed per 100 grams of the sample material.

In one suitable embodiment, the IV range is from about zero to about 70. In another embodiment, the FSA is made with fatty acid precursors with a range of IV from about zero to about 40. In another embodiment the compositions of the present invention comprises an IV range of from at least about 40 to about 70;

Further, while it is acceptable to use cationic softening compounds a transition temperature from about −50° C. to about 100° C.; in one embodiment provides for a fabric softening compound with a transition temperature of equal to or less than about 50° C.

C. Solvent

It has been reported that principal solvent can be used at a level up to about 40% by weight, alternatively from about 1% to about 25%, alternatively from about 3% to about 8%, by weight of the composition to provide clear and/or translucent fabric enhancer formulations. The term Principal Solvent is referred to herein as defined in U.S. Pat. No. 6,875,735 at col. 14, lines 28 et seq., sub-section titled "Principal Solvent System." The present invention has surprisingly found that fabric enhancer compositions comprising nano-sized particles as disclosed herein, provide clear and/or translucent compositions without the need for the previously disclosed "Principal Solvent Systems" or the "high electrolyte level and/or phase stabilizers" from U.S. Pat. No. 6,875,375 at col. 14, lines 29-57. Although these additives are not needed to provide the present clear and/or translucent fabric enhancer, a wider range of solvents (including solvents other than Principal Solvents) can be used without negatively impacting clarity of translucence.

It has further been reported that without the high level of electrolyte, the ClogP of the principal solvent system as disclosed hereinafter would typically be limited to a range of from about 0.15 to about 0.64 as disclosed in U.S. Pat. No. 5,747,443. It is known that higher ClogP compounds, up to about 1 can be used when combined with other solvents as disclosed in PCT/US98/10167 to Tordil et al, filed May 18, 1998, or with nonionic surfactants, and especially with the phase stabilizers disclosed herein as previously disclosed in U.S. Pat. No. 6,608,024 to DuVal et al. Although it has been reported that compositions with the electrolyte of U.S. Pat. No. 6,875,375 (the '375 patent) present, the level of principal solvent can be less and/or the ClogP range that is usable is broadened to include from about −2.0 to about 2.6, alternatively from about −1.7 to about 1.6, and alternatively from about −1.0 to about 1.0, it has surprisingly been found that fabric enhancers according to the present invention, comprising the disclosed nano-sized particles do not require the presence of the '375 patent electrolytes to accommodate lower levels of principal solvent and/or the aforementioned broadened range of ClogP values.

Organic solvents which are compatible with the FSA can be used herein. In one embodiment, the solvent comprises a mono-ol solvent, a polyol solvents, and mixtures thereof. Suitable solvents comprise diol and triol solvents such as glycols, glycerol and erithritol; 1,2 propanediol, dipropylenglycol, glycerol and mixtures thereof. Further examples include, C4-C10 linear and branched n- and iso alcohol, Ethylene glycols such as Mono Ethylene glycol, Diethylene glycol, Triethylene glycol, Polyethylene glycols MW 200 up to MW 1000, Propylene Glycols such as Mono Propylene glycol, Dipropylene glycol, Tripropylene glycol, Poly propylene glycols MW 300 up to 1300, glycerol, erythritol, methyl, ethyl, propyl esters of the above and/or mixtures thereof.

With the present invention, levels of solvent that are less than about 15% by weight of the composition can be used, which is suitable for odor, safety and economy reasons, alternatively less than about 10%, alternatively less than about 3.5%, alternatively less than about 1% of said solvent. In another embodiment, the fabric enhancer composition is free or substantially free of a solvent. As used herein, substantially free of a component means that no amount of that component is deliberately incorporated into the composition.

D. Electrolyte

It has been reported that relative high levels of electrolyte, e.g., from about 0.5% to about 10%, alternatively from about 0.75% to about 3%, and alternatively from about 1% to about 2%, by weight of the composition provides at least one benefit selected from (a) lowers the amount of principal solvent having a ClogP of from about 0.15 to about 0.64 or 1, which is required to provide clarity (It can eliminate the need for such a principal solvent completely); (b) modifies the viscosity/elasticity profile on dilution, to provide lower viscosity and/or elasticity; and (c) modifies the range of ClogP of acceptable principal solvents that will provide clarity/translucency. U.S. Pat. No. 5,759,990, discloses that suitable principal solvent can have a ClogP of from about 0.15 to about 0.64. A high electrolyte level reportedly allows the use of principal solvents with a ClogP within ranges having suitable lower limits of: −2.0; −1.7; −1.0; and 0.15 and suitable upper limits of: 2.6; 2.0; 1.6; 1.0; and 0.64. See U.S. Pat. No. 6,875,735 at col. 17, lines 30 et seq., sub-section titled "Electrolyte."

The present invention has found that one or more of the previously mentioned benefits can be obtained without dependence on the reported electrolytes. In one embodiment, the fabric enhancer an electrolyte level from about 0.001% to about 0.5%. In one embodiment, the fabric enhancer is free or substantially free of electrolyte.

E. Other Elements

1. Perfume Additive

In one embodiment, the fabric enhancer comprises a perfume additive. As used herein "perfume additive" means any odoriferous material that is subsequently released into the aqueous bath and/or onto fabrics contacted therewith. The perfume additives herein can be relatively simple in their compositions or can comprise highly sophisticated complex mixtures of natural and synthetic chemical components, all chosen to provide any desired odor. More information about perfume actives, including nonlimiting examples of different perfume compositions is available in U.S. Pat. Publ. No. 2003/0104969A1 issued Jun. 5, 2003 to Caswell et al.; U.S. Pat. No. No. 5,714,137 issued Feb. 3, 1998 to Trinh et al.; and U.S. Pat. No. 6,048,830 issued Apr. 11, 2000 to Gallon et al. In one embodiment, the present invention comprises from about zero % to about 5%, alternatively from about 0.1% to about 2.5%, alternatively from 0.3% to 1.5% of a perfume additive.

2. pH Modifiers

In one embodiment, the fabric enhancer composition further comprises a pH modifier in an appropriate amount to make the fabric enhancer composition acidic, having a pH in the range of below about 6; alternatively below about, alternatively from about 2 to about 5, alternatively from 2.5 to 4. Suitable levels of pH modifiers are from about zero % to about 4% by weight of the fabric enhancer composition, alternatively from about 0.01% to about 2%. Suitable pH modifiers comprises hydrogen chloride, citric acid, other organic or inorganic acids, and mixtures thereof.

3. Additional Additives

Those of ordinary skill in the art will recognize that additional additives are optional but are often used in fabric enhancers. The fabric enhancer further comprises an additional additive comprising: water, colorants, perfumes, blooming perfumes, electrolytes, preservatives, optical brighteners, structurants, viscosity modifiers, deposition aids, stabilizers, shrinkage controllers, spotting agents, germicides, fungicides, anti-corrosion agents, and mixture thereof, etc. See e.g. U.S. Pat. No. 4,157,307 to Jaeger et al., U.S. Pat. No. 5,942,217 to Woo et al., and U.S. Pat. No. 6,875,735 to Frankenbach et al. Additional suitable additives are known and can be included in the present formulation as needed. See e.g. U.S. Pat. Publ. No. 2004/0204337. In one embodiment, the fabric enhancer is free or substantially free of any of the aforementioned additives.

In one embodiment, the compositions of the present invention are free or substantially free of detersive surfactants. In one embodiment, the composition comprises less than about 5% of a detersive surfactant, alternatively less than about 2%, alternatively less than about 1%, alternatively less than 0.5%, by weight of the composition.

In another embodiment, the fabric enhancers of the present invention are free or substantially free of biological active (cosmetic or pharmaceutical) agents which are suited towards treating the symptoms and/or disorders of living organisms, notably of the skin and hair. Further, in one embodiment, the composition is free of materials which are oxygen sensitive (e.g. agents such as retinol). U.S. Pat. Publ. Nos. 2002/0001613A1, at paragraph 45-48, and 2001/0124033, at ¶¶ 42-43, provide examples of "biological active" agents which are notably absent in this embodiment of the present invention.

II. Composition Clarity and/or Translucence

It has surprisingly been found that compositions comprising the disclosed nano-sized particles provide clear and/or translucent compositions without the need for added amounts of electrolyte and/or solvent. Fabric enhancer composition comprising an FSA having a plurality of nano-sized particles of the present invention provide a clarity value of below about 320 NTU, alternatively less than about 250 NTU, alternatively less than about 200 NTU, alternatively less than about 150 NTU, alternatively less than about 100 NTU, as measured by Turbimeter test method disclosed herein. Compositions with a clarity value below about 150, alternatively below about 100 are "clear" while those with a clarity value below about 320, alternatively below about 250 are "translucent."

Although, clear and/or translucent compositions can be obtained with the nano-sized particle technology herein disclosed, it has been found that even lower NTU values can be obtained by adding solvent. In one embodiment, where the fabric enhancer composition comprising a FSA having a plurality of nano-sized particles of the present invention; and from about 1% to about 30% of a solvent, a clarity value of below about 300 NTU, alternatively below about 150 NTU, alternatively below about 70 NTU, alternatively below about 50 NTU, is obtained. Further, it has been found that addition of perfume to the FSA with or without added solvent, provides a clarity value of below about 300 NTU, alternatively below about 140 NTU, alternatively below about 70 NTU.

As used herein, the clarity value is determined using a Hach Model 2100P Portable Turbidimeter ("Turbimeter"), Manufacturer: Hach Company, P.O. Box 389, Loveland, Colo. 80539, USA. StablCal is a trademark of Hach Company.

A. Turbidimeter Turbidity Method

The Turbidimeter measures the turbidity from 0.01 NTU to 1000 NTU. The Turbidimeter operates on the nephelometric principle of turbidity measurement. The Turbidimeter's optical system includes a tungsten-filament lamp, a 90° detector to monitor scattered light and a transmitted light detector. The Turbidimeter's microprocessor calculates the ratio of the signals from the 90° and of transmitted light detectors. This ratio technique corrects for the interferences from color and or light absorbing materials and compensates for fluctuations in the lamp intensity.

Calibration uses the accessory StablCal® Secondary standards coming with the Turbidimeter. The undiluted sample is contained in the sample cell, the outer cell wall is wiped free of water and finger prints. A thin coat of silicone oil is applied to the outer wall of the sample cell in order to mask minor imperfections and scratches on the sample cell wall, which may contribute to turbidity or stray light. A measurement is taken and result is displayed in NTU units. All samples are equilibrated and measured at 25° C.

The samples are measured within 24 h after making.

III. Processes of Making

It has surprisingly been found that the compositions of the present invention can be manufactured using a process which involves cavitation within the composition generated by either ultrasonic mixing or a hydrodynamic cavitation reactor. Without intending to be bound by theory, it is believed that the hydrodynamic or ultrasonic cavitation causes sufficient disruption within the composition to create nano-sized particles according to the present invention.

One suitable process for manufacturing the present compositions comprises the steps of providing a feed into a mixing chamber, where the feed contains at least a FSA and a solvent such as an aqueous carrier; then exerting an energy density onto said feed from about 1 J/ml to about 100 J/ml, alternatively from about 1 J/ml to about 50 J/ml, alternatively from about 5 J/ml to about 35 J/ml with a residence time of from about 1 millisecond to about 1 second, alternatively from 1 millisecond to 100 milliseconds, to cause intense cavitation within the feed within the mixing chamber. In another embodiment, the feed further comprises a pH modifier, a perfume, a solvent, and mixtures thereof. In another embodiment, the feed is introduced into the mixing chamber using a single feed, where different compositions are combined prior to introduction into the mixing chamber. In another embodiment, the feed is not pre-mixed before being introduced into the mixing chamber.

It is believed that subjecting the feed to an energy density onto said feed from about 1 J/ml to about 50 J/ml causes cavitation within the composition traveling within the mixing chamber causes sufficient disruption to the feed within the mixing chamber to cause the cationic softening compound to form nano-sized lamellar vesicles according to the present invention.

Dual feed systems are also suitable, wherein one feed can be a combination of FSA and other additives and the second feed can be water and acid. In one embodiment, one or both of these feeds can be premixed. Further, multi-feed systems can be used in accordance with the present invention. In a dual feed process, a first feed comprises the hydrophobic ingredients comprising FSA, and a second feed comprising hydrophilic ingredients comprising water. In this dual feed process, the process comprises, forming a first feed comprising from about 5% to about 100% of a fabric softening active, alternatively from about 5% to about 85% of a fabric softening active; from about zero to about 70% of a solvent and with from about zero % to about 30% of a perfume, by weight of said first feed; premixing said first feed to form a premixed first feed; combining said premixed first feed with a second feed comprising up to 100% of water in a mixing chamber; subjecting said feed to an energy density from about 1 J/ml to about 50 J/ml thereby producing said fabric enhancer; and discharging said fabric enhancer at a flow rate from about 1 kg/min to about 1000 kg/min. In another embodiment, the second feed can further comprises a pH modifier, such as hydrochloric acid, a solvent, a perfume, and mixtures thereof. In yet another embodiment, the premixed first feed and the second feed are combined in a mixing chamber wherein the combined feed is forced through an orifice at a sufficient flow rate to ensure a pressure drop across the orifice of between about 100 bar and about 500 bar. In one embodiment, the premixed first feed can be introduced at from about 10° C. to about 95° C., alternatively from about 20° C. to about 85° C., and the second feed can be introduced at from about 50° C. to about 95° C., alternatively from 70° C. to about 90° C.

In one embodiment, the device used to manufacture the fabric enhancer of the present invention is an ultrasonic mixer. One non-limiting example of a commercially available device for use herein, includes the ultrasonic homogenizer is the Sonolator™, supplied by Sonic Corporation of Connecticut.

A. Energy Density

Energy Density is generated by exerting a power density on the feed within the mixing chamber for a residence time. In one embodiment of the present invention, the step of cavitating said feed in said mixing chamber is performed having an energy density from about 1 J/ml to about 100 J/ml, alternatively from about 1 J/ml to about 50 J/ml, alternatively from about 5 J/ml to about 35 J/ml. Energy Density can be represented by the equation:

$$E=W*\Delta T$$

Where E represents energy density, W represents power density, and ΔT represents residence time. As defined herein, residence time means the average amount of time a vesicle remains within the mixing chamber. Residence time is determined by calculating the cavity size divided by the flow rate of fabric enhancer out of the mixing chamber.

B. Power Density and Residence Time

The fabric softener compositions of the present invention require relatively higher power density than conventional high sheer mixing. For ultrasonic mixing or a hydrodynamic cavitation reactor as used herein, power density can be determined by:

$$W=\Delta P/\Delta T$$

where W is the Power Density, ΔP is the applied pressure within the mixing chamber, and ΔT is the residence time.

In one embodiment, the energy density is generated from a power density of from about 0.5 W/ml to about 100,000 W/ml, alternatively from about 50 W/ml to about 30,000 W/ml. It is observed that the minimum Power Density required to achieve the fabric enhancer of the present invention is about 0.5 W/ml at 20 kHz.

Where the power density is about 0.5 W/ml, the residence time is about 15 minutes;

alternatively, where the power density is about 100,000 W/ml the residence time is about 5 milliseconds. In one embodiment, the residence time is from about 1 millisecond (ms) to about 1 second, alternatively from about 1 ms to about 100 ms, alternatively from about 5 ms to about 50 ms. Further, where the residence time is less than 1 minute, the power density needs to be greater than 10 W/ml. Where the residence time is less than 1 second, the power density needs to be greater than 500 W/ml; alternatively. Where the residence time is less than 10 ms, the power density needs to be greater than 50,000 W/ml.

After the feed is subjected to the requisite energy density (as generated from the above mentioned power density and residence time), the fabric enhancer is discharged at a flow rate from about 1 kg/min to about 1000 kg/min, alternatively 10 kg/min to about 500 kg/min. Flow rate can be represented by the equation $Q=30A\sqrt{(\Delta P)}$, where Q=flow rate, A=orifice size, and ΔP= pressure within the mixing chamber. As defined herein, orifice size is the orifice cross sectional area. In one embodiment, the orifice size is from about 0.0001 inches$^2$ to 0.1 about inches$^2$, alternatively 0.0005 inches$^2$ to 0.1 about inches$^2$.

IV. Examples

Fabric enhancers with narrow particle size distribution and clear to translucent appearance can be prepared with the Sonolator™.

The FSA used is a quaternary ammonium compound known as a hard tallow DEEDMAC with the following chemical name: N,N-di(tallowoyloxyethyl)-N,N-dimethylammonium chloride. This fabric softening active is available from Degussa under the trade name of Rewoquat V 3282 and has an IV value of about 18-22.

Example 1

Dual Feed Mode

The following three examples of fabric enhancers are prepared by combining a active premix (including hydrophobic materials such as FSA+solvent+perfume if applicable) and a aqueous solution premix (including hydrophilic materials such as water+HCl+Glycerol) as continuous pressurized streams into a Sonolator™.

| % w/w | Example 1A | Example 1B | Example 1C |
|---|---|---|---|
| DEEDMAC | 13.35 | 13.35 | 13.35 |
| 1,2 propanediol | 3.125 | 3.125 | 3.125 |
| Glycerol | 0 | 0 | 20 |
| Hydrogen Chloride | ~0.012 | ~0.012 | ~0.012 |
| Perfume | 0 | 0.7 | 0.7 |
| Optional Additives | 0 | 0 | 0 |

(1)determined with Hach 2100P Turbidimeter

A. Premixing:

Actives premix:

| | Composition in % w/w | |
|---|---|---|
| | Example 1A | Example 1B and 1C |
| DEEDMAC | 81.4 | 77.5 |
| 1.2 propanediol | 18.6 | 18.5 |
| Perfume | 0 | 4.0 |

Aqueous solution premix:

| | Composition in % w/w | |
|---|---|---|
| | Example 1A & 1B | Example 1C |
| Water | 99.96 | 75.80 |
| HCl 32% | 0.04 | 0.04 |
| Glycerol | 0 | 24.16 |

B. Dual feed mixing:

The two premixes are fed into a Sonolator™ at the indicated dosage at flow rates of 5.5-10 L/min and working pressure of 300 to 320 bar. The orifice size is chosen in function of the flow rate and Δ pressure and set to 0.0008 square inch in the experiment. The flows are expressed as % of the total throughput.

| Feed settings and Temperature [% v/v and ° C.] | | | |
|---|---|---|---|
| | Sample 1A | Sample 1B | Sample 1C |
| Active Premix Stream | 16.38% (71.7° C.) | 17.32% (71.0° C.) | 17.32% (75.3° C.) |
| Aq. Soln. Premix Stream | 83.62% (52.6° C.) | 82.68% (49.1° C.) | 82.68% (50.4° C.) |
| Δ pressure | 301 bar | 316 bar | 311 bar |
| Energy density | 30.1 J/ml | 31.6 J/ml | 31.1 J/ml |

Particle characterization: Malvern Zetasizer Nano ZS[2]

| Parameter | Sample 1A | Sample 1B | Sample 1C |
|---|---|---|---|
| % <100 nm | 77.2 | 86.5 | 87.0 |
| % <170 nm | 95.0 | 96.7 | 97.0 |
| Average particle size [nm] | 50.9 | 41.4 | 37.5 |
| Clarity [NTU] | 174 | 145 | 105 |

[(2)]determined with Malvern Zetasizer Nano instrument, sample dilution 5x with water and HCl, 1,2 propanediol as described above.

Example 2

The clarity of fabric enhancers is dependant on operating pressure. Dual feed settings and temperature are identical to example 1, Actives stream is at about 75° C., aqueous solution is at about 50-55° C.

| % w/w | Example 2 & 3 |
|---|---|
| DEEDMAC | 13.35 |
| 1,2 propanediol | 3.125 |
| Glycerol | 15 |
| Hydrogen Chloride | ~0.012 |
| Perfume | 0.96 |
| Minors | 0-0.5 |

| | Sample 2A | Sample 2B | Sample 2C |
|---|---|---|---|
| Δ pressure | 100 bar | 200 bar | 300 bar |
| Clarity [NTU] | 217 | 144 | 148 |

Example 3

Preformed fabric enhancer compositions having the same components as Example 2 are recycled within the Sonolator™ for multi-passes at 300 bar. A total of ten complete passes is done to increase clarity from 263 NTU to 170 NTU.

| | Sample 3A | Sample 3B |
|---|---|---|
| No of multipasses | 2x | 10x |
| Clarity [NTU] | 263 | 170 |

Example 4

Conventional fabric enhancer composition starting materials are fed into the Sonolator™ for multi-passes at 5000 psi. A total of eight complete passes are performed. The average particle size is less than about 100 μm with a turbidity reading of about 100 NTU (using the Turbidimeter Turbidity Method).

Example 5

In another experiment, the esters of quaternary ammonium compounds (softness active) and acidic water are fed into the Sonolator™ via two different streams into the mixing chamber of a Sonolator™. Further, no additional electrolyte or additional solvent is added. One pass is run at a Δ pressure of about 5000 psi. A plurality of nano-sized particles with particle size less than about 100 nm are produced. The clarity value of the finished fabric enhancer liquid less than about 150 NTU.

Example 6

In another experiment at a lower operating pressure as compared to the above examples, the esters of quaternary ammonium compounds (softness active) and acidic water are fed into the Sonolator™ via two different streams. Further, no additional electrolyte is added to form the vesicles as previously disclosed as being necessary. For each of the runs below, one pass is run at the A pressure with varying FSA concentration and varying orifice size.

| Example | Concentration of FSA % w/w | Δ pressure (Psi) | Orifice size (Square inches) | Viscosity @ low shear (cps) | Turbidity (NTU) |
|---|---|---|---|---|---|
| 6A | 14 | 1800 | 0.002 | 20000 | 211 |
| 6B | 10 | 1800 | 0.002 | 200 | 309 |
| 6C | 5 | 1800 | 0.002 | 8 | 317 |
| 6D | 14 | 1800 | 0.001 | 1000 | 222 |

For examples 4-6, the FSA used is a soft tallow BFA with the following chemical name: N,N-di(tallowoyloxyethyl)-N, N-dimethylammonium chloride, available from Degussa under the trade name of Adogen SDMC and has an IV value of about 56.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Except as otherwise noted, the articles "a," "an," and "the" mean "one or more."

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

All documents cited in the DETAILED DESCRIPTION are, in the relevant part, incorporated herein by reference; the citation of any document is not to be construed as an admission that it is prior art with respect to the present invention. To the extent that any meaning or definition of a term or in this written document conflicts with any meaning or definition in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric enhancer that is substantially free of detersive surfactants and substantially free of cosmetic or pharmaceutical agents, comprising: from about 1% to about 30% by weight of the enhancer of at least one cationic nitrogenous salt fabric softening active, wherein said at least one fabric softening active comprises a plurality of particles comprising an intensity weighted particle size distribution wherein greater than about 95% of said plurality of particles have a size below about 170 nm, wherein said fabric enhancer further comprises a acidic water and perfume and has a clarity value below about 140 NTU and wherein said fabric enhancer comprises less than about 3.5% by weight of said fabric enhancer of an organic solvent and has a pH of 2.5 to 4.

2. The fabric enhancer according to claim 1, comprising greater than about 98% of said particles have a size below about 170 nm.

3. The fabric enhancer according to claim 1, wherein said at least one fabric softening active comprises at least one quaternary ammonium compound.

4. The fabric enhancer according to claim 3, wherein said quaternary ammonium compound contains at least one ester-bond.

5. The fabric enhancer according to claim 3, wherein said quaternary ammonium compound comprises N,N-di(acyloxyethyl)-N,N-dimethylammonium chloride.

6. The fabric enhancer according to claim 3, wherein said at least one fabric softening active has an IV of from about 1 to about 40.

7. The fabric enhancer according to claim 3, wherein said at least one fabric softening active has an IV of from about 40 to about 70.

8. The fabric enhancer of claim 1, wherein said organic solvent comprises a mono-ol solvent, a polyol solvents, and mixtures thereof.

9. The fabric enhancer according to claim 1, further comprising less than about 0.5% by weight of said fabric enhancer of electrolyte.

10. The fabric enhancer according to claim 9, comprising less than about 1% by weight of said fabric enhancer of an organic solvent.

11. The fabric enhancer of claim 1, wherein said plurality of particles further comprises an average particle size from about 30 nm to about 120 nm.

* * * * *